US008631842B2

(12) United States Patent
Dancescu et al.

(10) Patent No.: US 8,631,842 B2
(45) Date of Patent: Jan. 21, 2014

(54) WATER BALLOON FILLER AND TIER

(76) Inventors: Cristian Dancescu, Tigard, OR (US); Diane Ciot, Vancouver, WA (US)

( * ) Notice: Subject to any disclaimer, the term of this patent is extended or adjusted under 35 U.S.C. 154(b) by 731 days.

(21) Appl. No.: 12/910,861

(22) Filed: Oct. 24, 2010

(65) Prior Publication Data

US 2012/0097293 A1 Apr. 26, 2012

(51) Int. Cl.
*B65B 1/04* (2006.01)

(52) U.S. Cl.
USPC ..... 141/353; 141/114; 141/313; 141/352; 446/367; 289/17

(58) Field of Classification Search
USPC ..... 141/114, 313, 317, 351–354; 446/220, 446/367; 289/17
See application file for complete search history.

(56) References Cited

U.S. PATENT DOCUMENTS 5,762,117 A * 6/1998 Law ..... 141/198

* cited by examiner

*Primary Examiner* — Jason K Niesz
(74) *Attorney, Agent, or Firm* — Baumgartner Patent Law; Marc Baumgartner

(57) ABSTRACT

Novel water balloon filling devices and tying fixtures are disclosed herein. Preferred filling devices are configured to attach to a water spigot or hose and include a spring valve that is protected from internal water flow. Preferred tying fixtures can include two prongs having diverging end sections.

16 Claims, 5 Drawing Sheets

WATER BALLOON FILLER AND TIER

FIELD OF THE INVENTION

The embodiments herein relate to devices configured to quickly and rapidly fill water balloons, and more preferably includes tying fixtures that allows users to quickly knot the filled balloons. More specifically, the filling devices herein include attachment means to a water source and include a user activated valve to allow for the filling of the balloons. A two pronged tying fixture can be configured to readily attach to the filling device and according to more specific embodiments can be releasably attachable.

BACKGROUND

Water balloon tosses and fights are enjoyable pastimes for many people, but the filling and the tying of the water balloons beforehand can be time consuming and problematic. Without the aid of a filling device, it is difficult for a user to stretch the new balloon over a water spigot or hose. The balloons can easily tear or slip off the spigot. Filling devices have been developed, but there are disadvantageous with them.

One example of a current water balloon filling device is called the Quick Knot Water Bomb Set, available from Imperial Toy. This particular device relies on a rotatable valve to allow water flow into the balloon. This configuration makes it difficult for a user to use only one hand when filling up the water balloon, as one hand is used to hold the balloon and one hand is used to rotate the valve to start and stop water flow into the balloon.

Another example of an available water balloon filling device is called the Water Bomb Factory, available from AquaAntics. This specific device is directed to upright water balloon filling and utilizes a vice clamp to do so. Disadvantageously, this device's design exposes the internal metal spring to the flowing water, which could lead to water damage, including rust.

With respect to tying a knot in the filled water balloon, balloon tying devices are known, including two pronged devices. Both the Quick Knot Water Bomb Set, the Water Bomb Factory, and U.S. Pat. No. 4,989,906 ('906 Patent) to Peverly teach two pronged tying devices. The Quick Knot Water Bomb Set utilizes two parallel prongs while the Water Bomb Factory and the '906 Patent include prongs with ends that curve inward towards each other. Prongs that are parallel or have inwardly curving ends can inadvertently lead to the balloon slipping off of the tying fixture as a user is trying to finish the knot.

In light of the disadvantages described above, there is a need in the art for new water balloon filling and tying devices that improve on currently available goods.

SUMMARY OF THE INVENTION

Embodiments herein are directed to water balloon filling devices comprising: (a) an attachment member having an upper opening configured to operably couple with a pressurized water source; (b) a main housing, having an upper portion coupled to the attachment member; (c) a spring vertically traversing within the main housing and having a bottom portion coupled to a lower nozzle, and configured to contract upwards and expand downwards; (d) an internal liner vertically traversing within the main housing, and having an upper opening in fluid communication with the attachment member and a lower opening in fluid communication with the lower nozzle, wherein the liner is configured such that no significant amount of water comes into contact with the spring; (e) the lower nozzle configured with the spring to allow vertical movement further into the main housing, and having a top opening in fluid communication with the liner and a bottom opening configured for filling a water balloon; and (f) a stationary stem vertically traversing within the main housing, and comprising a bottom plug that is configured to fit snugly within the nozzle's bottom opening when the spring is expanded to prevent significant water flow out of the nozzle's bottom opening and wherein a gap is created between the bottom plug and the nozzle's bottom opening when the nozzle is pushed upwards, thereby contracting the spring.

BRIEF DESCRIPTION OF THE DRAWINGS

It will be appreciated that the drawings are not necessarily to scale, with emphasis instead being placed on illustrating the various aspects and features of embodiments of the invention, in which.

DETAILED DESCRIPTION OF THE ILLUSTRATED EMBODIMENTS

Embodiments of the present invention are described below. It is, however, expressly noted that the present invention is not limited to these embodiments, but rather the intention is that modifications that are apparent to the person skilled in the art and equivalents thereof are also included.

Figure 1:
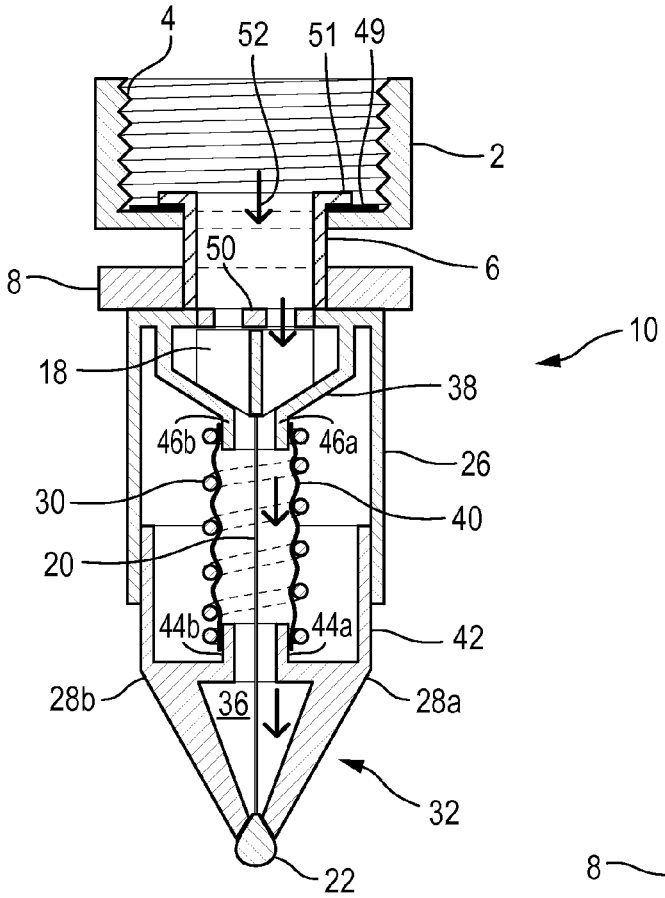
FIG. 1 is an internal view of a preferred water balloon filling device in a closed position.

FIG. 1 depicts a cutaway view of a preferred water balloon filling device 10 in a closed position, where water is blocked from escaping through the nozzle 32. Advantageously, the top of the device 10 includes an attachment member 2 having internal threads 4 configured to screw onto standard threads on the end of a garden hose or spigot. The attachment member 2 can be configured to be rotatable around the targeted garden hose or spigot, in order to engage or disengage the threads 4 to the spigot or hose. When the hose or the spigot is turned on, water 52 flows into the attachment member 2. The attachment member 2 includes an internal cavity that is water sealed or substantially so, such that water leaking out of the attachment member 2 is limited or non-existent. Alternatively, the attachment member can include means for attaching to any pressurized water dispensing device, regardless of threads or not.

Possible non-preferred means of attachment non-exclusively include, suction, friction, snaps, screws, clips, clamps, tape, and the like.

Figure 2:
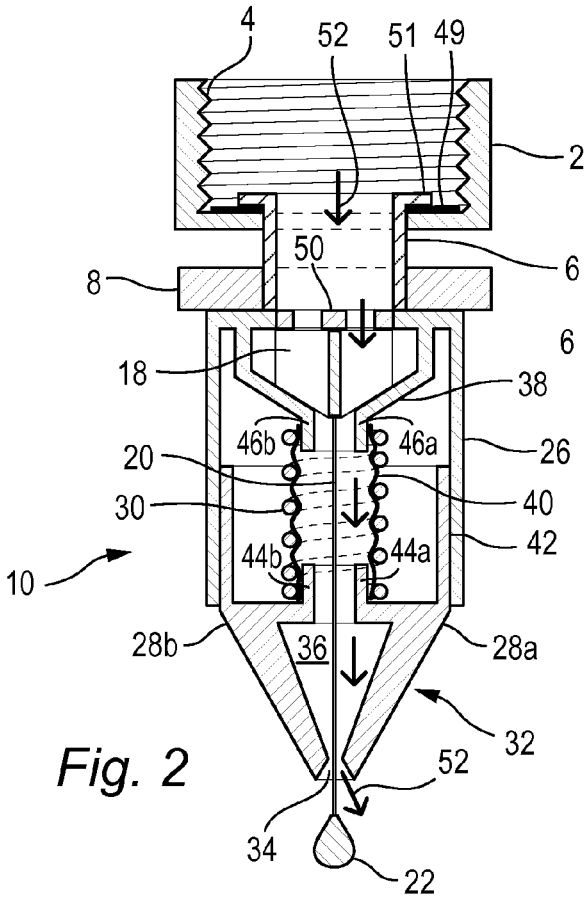
FIG. 2 is an internal view of a preferred water balloon filling device in an open position.
Figure 7:
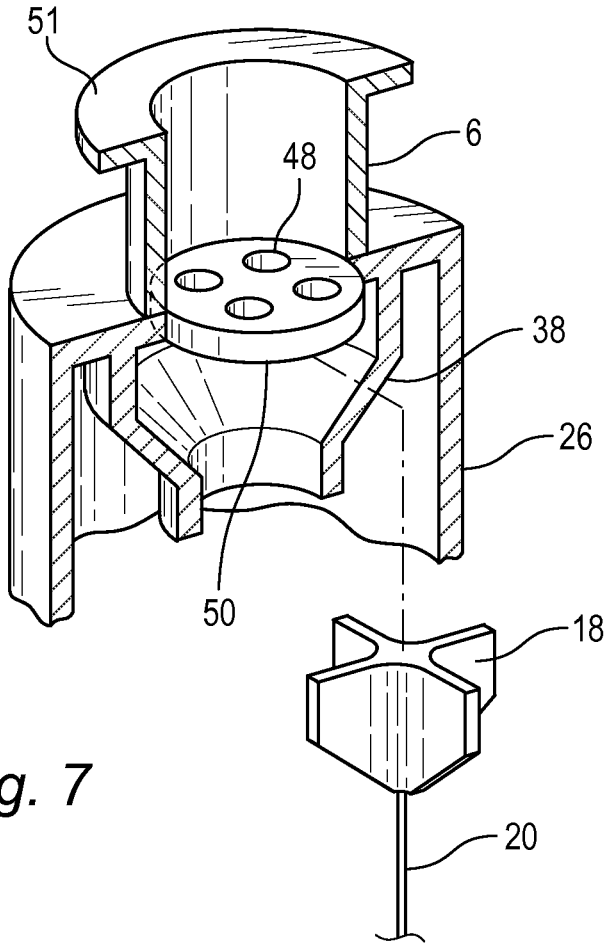
FIG. 7 is a close up view of the grate and the top of the stem.

From the inside cavity of the attachment member 2 water 52 flows down the balloon filling device 10 via gravity and/or water pressure into a connecting channel 6. The connecting channel 6 can be cylindrical and preferably has a diameter configured to fit through the aperture 12 of the tying fixture 8, which will be discussed in more detail below. The connecting channel 6 has a top portion that couples to the bottom of the attachment member 2 and includes one or more holes to allow water flow 52 from the attachment member 2 into the connecting channel 6. As shown in FIGS. 1, 2, and 7, the connecting channel 6 can couple to the attachment member 2 through the use of a flange 51. The flange 51 can be circular or otherwise suitably shaped, and advantageously is supported by the bottom of the attachment member 2. The flange 51 can be supported directly by the bottom of the attachment member 2 or alternatively, can rest upon a gasket 49 positioned below it. The gasket 49 is configured to prevent any substantial amount of water from escaping from the attachment member 2.

According to preferred embodiments, the channel 6 is configured to be stationary such that the attachment member 2 can rotate around it to screw on and off a desired spigot or hose. The connecting channel 6 also includes a bottom portion that couples to the main housing 26 of the water balloon filling device 10. According to preferred embodiments, the bottom of the connecting channel 6 includes one or more openings that feed into an inner compartment 38 which is internally positioned within the main housing 26. According to more specific embodiments, the bottom portion of the connecting channel is a grate 50. The grate 50 preferably includes a plurality of apertures 48 that allow water 52 to flow downward from the connecting channel 6 into the main housing 26. The apertures 48 can be any suitable shape, including circular, rectangular, square, etc. Alternatively, the connective channel 6 can be absent according to certain embodiments, such that the main housing 26 operably couples to the attachment member 2 directly.

Figure 8:
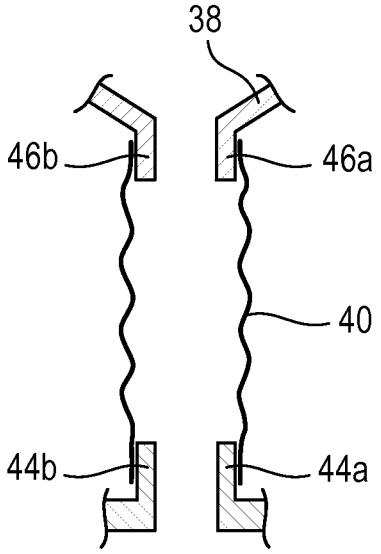
FIG. 8 is a close up view of the internal liner.

The inner compartment 38 is positioned within the central housing 26, and thus has a smaller volume and diameter than the central housing 26. The inner compartment 38 can advantageously comprise left and right downward extensions 46*a* and 46*b* that respectively couple to the top of the left and right sides of a liner 40, as shown in FIG. 8 Likewise the bottom of the liner 40 is preferably coupled to left and right upward extensions 44*a* and 44*b* on a nozzle 32. Those with skill in the art will readily appreciate that the top of the liner 40 can couple to the inner compartment 38 and the bottom of the liner 40 can couple to the nozzle 32 in a multiple of other ways. According to certain embodiments, the filling devices herein lack an inner compartment and the spring 30 and the liner 40 couple directly to the grate 50 or elsewhere within the main housing 26.

The liner 40 itself and its' coupling points to the inner compartment 38 and the nozzle 32 are preferably constructed of a water impermeable material, or at least of a material that substantially restricts water from outwardly permeating into the central housing 26. It is additionally advantageous to have the liner 40 be made of a flexible material such that when the coiled spring 30 is wrapped directly around the liner 40 the liner 40 can compress and expand with the spring 30. Alternative embodiments include the spring 30 not directly touching the liner 40, and thus, according to certain embodiments, the liner 40 can be made of a rigid material. Examples of flexible waterproof liners that be used with the teachings herein include ethylene propylene diene monome (EPDM) flexible rubber and PVC flexible plastic, for example. By preventing outward water permeation, the liner 40 advantageously prevents the spring 30 (which can be made of metal) from coming into significant water contact and thereby prevents water damage, such as rusting. The liner 40 can be attached using any suitable means, such as an adhesive, and more preferably a waterproof adhesive.

Figure 4:
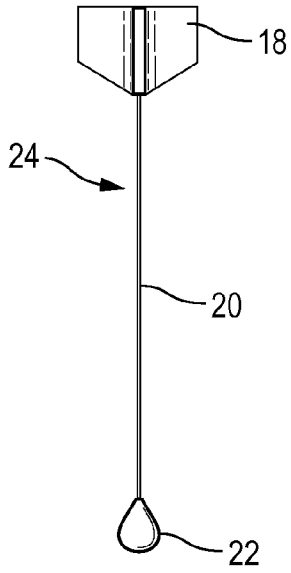
FIG. 4 is a side view of a stem.
Figure 5:
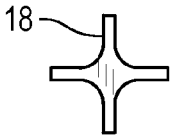
FIG. 5 is a top view of the stem.
Figure 6:
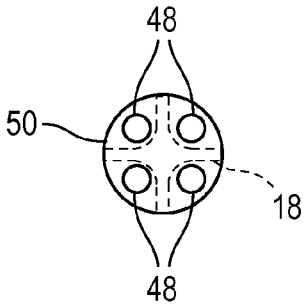
FIG. 6 is top view of a grate.

As shown in FIG. 4, the filling devices herein preferably include a stem 24 vertically traversing through the nozzle 32 to the top of the inner compartment 38. The stem 24 can include a top 18 coupled to a main body 20 and a lower end plug 22. The top 18, as shown in FIG. 5, is preferably in a cross shape having four extensions, and is positioned within the inner compartment 38 and below the grate 50, such that its four extensions do not block the apertures 48 positioned above it. According to advantageous embodiments, the top 18 of the stem 24 fits snugly within the inner compartment 38, such that the inner compartment 38 supports the stem 24. As shown in FIG. 6, the cross-shaped top 18 defines the boundaries of four quadrants on the grate 50, such that each quadrant includes an aperture 48 that allows water 52 flow downward. The cross shaped top 18 is advantageous in that it connects the stem 24 to the underside of the grate 50 at multiple positions and thus stabilizes the stem 24, which is a non-moving piece of the filling device 10. The central body 20 of the stem 24 vertically traverses within the liner 40 with the bottom portion of the body 20 ending in a plug 22 configured to block water flow 52 in the closed position (see FIG. 1) and to allow water flow 52 in the open position (see FIG. 2). The stem plug 22 is preferably concentric to the nozzle's 32 bottom opening and can be configured to any suitable shape including a tear drop or otherwise tapered upwards, spherical, and the like.

Figure 7A:
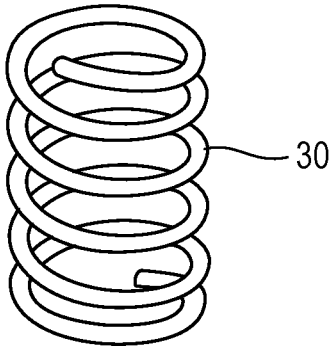
FIG. 7A is a perspective view of a spring.

As shown in FIG. 7A, a spring 30, preferably made of metal, is coupled to the inner compartment 38 and coils downward around the outside of the liner 40 to couple to the top of the nozzle 32. More specifically, the spring 30 can couple to the left and right downward extensions 46*a* and 46*b* on the inner compartment 38 that define a channel allowing water flow into the liner 40. Likewise the bottom of the spring 30 is preferably coupled to left and right upward extensions 44*a* and 44*b* of a nozzle 32. Preferably, the left and right upward extensions 44*a* and 44*b* define a channel allowing water flow 52 into the cavity 36 of the nozzle 32.

As shown in FIGS. 1 and 2, the nozzle 32 can have the general shape of an inverted cone, or otherwise be tapered, thereby creating a small downward opening when the filling device 10 is in the open position. The bottom end of the nozzle 32 has a diameter much smaller than a conventional hose or spigot end, and preferably does not include metal threads. This configuration helps to prevent tearing of the balloon 104 and allows a user to more easily position and hold the opening end 102 of the balloon 104 on the nozzle 32 during filling.

As shown in FIG. 1, when the spring 30 is in its expanded, natural position, without any pressure exerted upwards on it, the nozzle 32 is in a downward, closed position such that the plug 22 of the stem 24 is positioned tightly against the bottom of the nozzle 32 and water flow 52 is prevented from escaping out of the nozzle 32, or substantially so. In contrast, and as shown in FIG. 2, when a user exerts upward pressure on the nozzle 32, such as at positions 28*a* and 28*b*, the coiled spring 30 compresses allowing the nozzle 32 to move upwards. More specifically, an upper portion 42 of the nozzle 32 slides upward, further into the central housing 26 of the filling device 10. As the nozzle 32 moves upwards, a gap 34 is created between the bottom portion of the nozzle 32 and the stationary stem plug 22. Water flow 52 will then escape out of the nozzle's cavity 36 and into a balloon 104.

Accordingly, to utilize the filling device 10, a user simply stretches the opening end 102 of a balloon 104 over the bottom of the nozzle 34. The hose or spigot can then be turned on to allow water flow 52 to enter into the attachment member 2, the liner 40, and the nozzle cavity 36. A user can then exert upward pressure, such as at positions indicated at points 28*a* and 28*b* in FIGS. 1 and 2. As the nozzle 32 is pushed upwards, water 52 flow downwards out of the nozzle's cavity 36 into the balloon 104. Once the user is satisfied with the amount of water in the balloon 104, they can release the upward pressure on the nozzle 34, thereby allowing the coiled spring 30 to expand back to its natural position, which in turn lowers the nozzle 34 such that it once again creates a seal with the stem plug 22 and prevents further water 52 from escaping out. The filling device 10 can thus be easily operated by having a user only utilize one hand. The same hand that hold's the balloon's opening end 102 over the nozzle 32 can exert upward pressure to allow water flow 52 to escape.

The filling devices herein are preferably made entirely of rigid plastic, such as a thermoplastic material, including: polypropylene, polystyrene or polyethylene, for example. The notable exceptions to this can include the spring 30 and the liner 40. As stated above, the spring 30 is preferably made of a metal and the liner 40 is preferably made of a flexible material, such as waterproof or water-resistant material. Plastic parts can readily be made by heating the plastic to a liquid form, pouring the liquid plastic into a mold in the shape of the desired part, and then cooling the mold to allow the plastic to harden into the desired shape.

Figure 3:
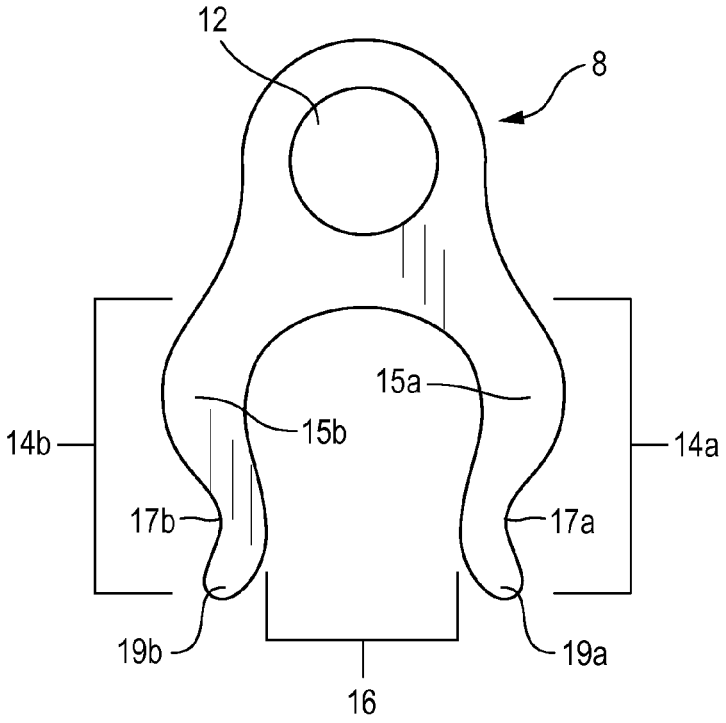
FIG. 3 is a perspective view of a preferred water balloon tying fixture.

After filling the balloon 104 with the desired amount of water 52, a user can utilize the tying fixture 8 to create a knot in the open end 102 of the balloon 104. One preferred tying fixture 8 is shown in detail in FIG. 3. The tying fixture 8 preferably includes an aperture 12 configured to fit around the connecting channel 6. The fit is preferably tight to prevent the tying fixture 8 from rotating around. The diameter of the aperture 12 is preferably smaller than that of the main housing 26 such that the main housing 26 couples to and supports the tying fixture 8. According to alternative embodiments, instead of being a solid aperture 12 as shown in FIG. 3, the tying fixture can be configured to releasably attach around the connecting channel 6, such as by including a slit on the opposite end of the main slot 16. This slit could allow a user to remove the tying fixture 8 from the connecting channel 6. This embodiment can be useful if a user wanted to traverse their finger through the aperture 12 to tie they balloon 104 in their hands away from the filling device 10. The tying fixture 8 can alternatively be attached to other portions of the filling devices 10 herein, such as around the main housing 26.

As shown in FIG. 3, two prongs 14*a* and 14*b* extend away from the aperture 12. Advantageously, the two prongs 14*a* and 14*b* are not configured to be parallel with respect to each other, nor do their ends 19*a* and 19*b* converge towards each other. While parallel prongs and converging prong ends can be used in non-preferred embodiments, it is preferred that the ends 19*a* and 19*b* of the prongs 14*a* and 14*b* diverge away from other to define a slot 16. According to even more preferred embodiments, and as shown in FIG. 3, the prongs 14*a* and 14*b* can include a first converging section 15*a* and 15*b* and diverging end points 19*a* and 19*b* such that slight grooves 17*a* and 17*b* are created at their junctures. As shown in this embodiment, the prongs 14*a* and 14*b* of the tying fixture 8 in FIG. 3 can be in the general shape of the Greek letter omega: Ω. The grooves 17*a* and 17*b* are useful in preventing the balloon 104 from slipping off the tying fixture 8, when the user is attempting to tie a knot. Preferred tying fixtures are made of plastic, such as a thermoplastic, for example.

Figure 9:
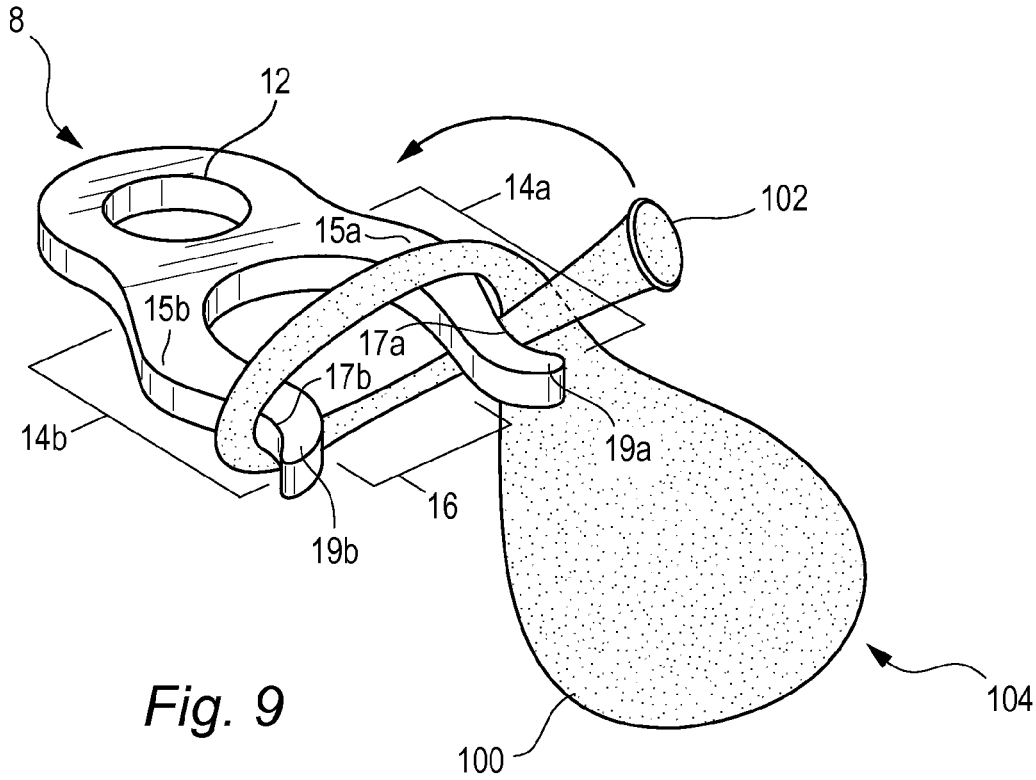
FIG. 9 is a perspective view of a filled water balloon's neck being wrapped around the tying fixture's two prongs to create a loop.
Figure 10:
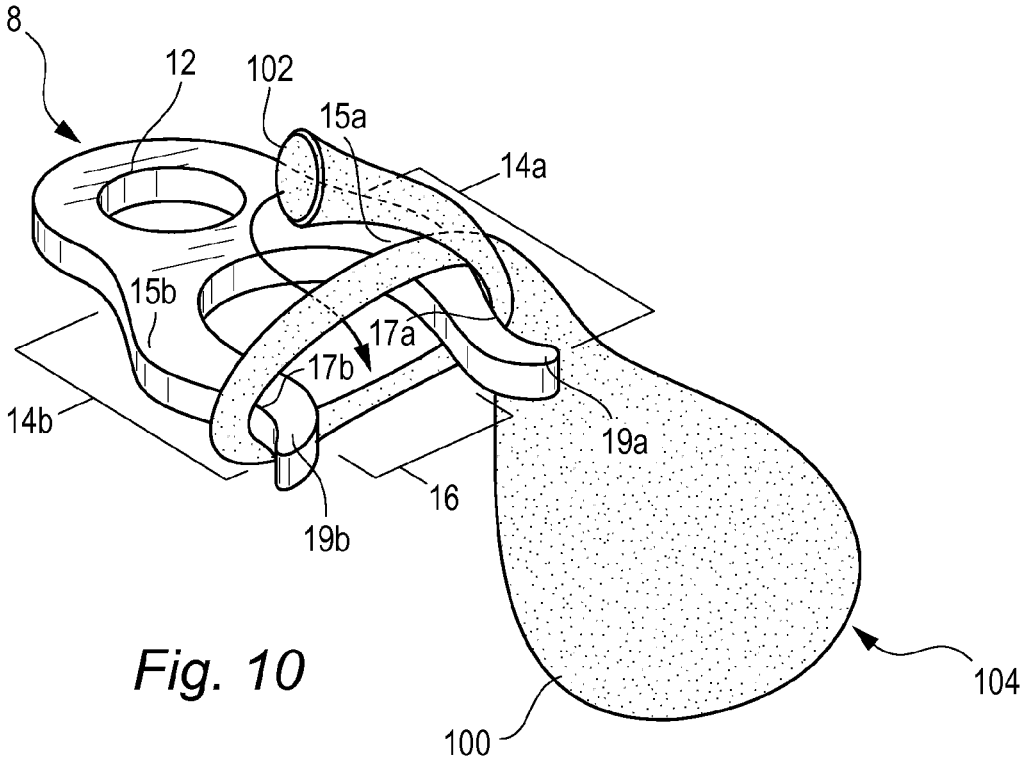
FIG. 10 is a perspective view of a filled water balloon's open end being aligned to pass through the loop.
Figure 11:
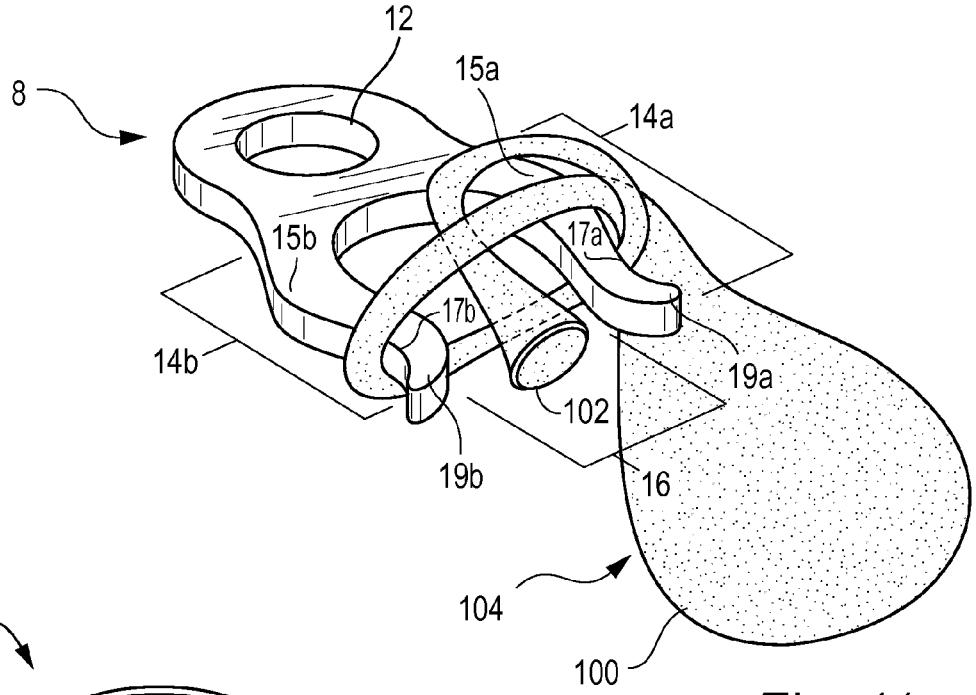
FIG. 11 is a perspective view of the end of a filled water balloon's open end being threaded through the loop between the tying fixture's two prongs.
Figure 12:
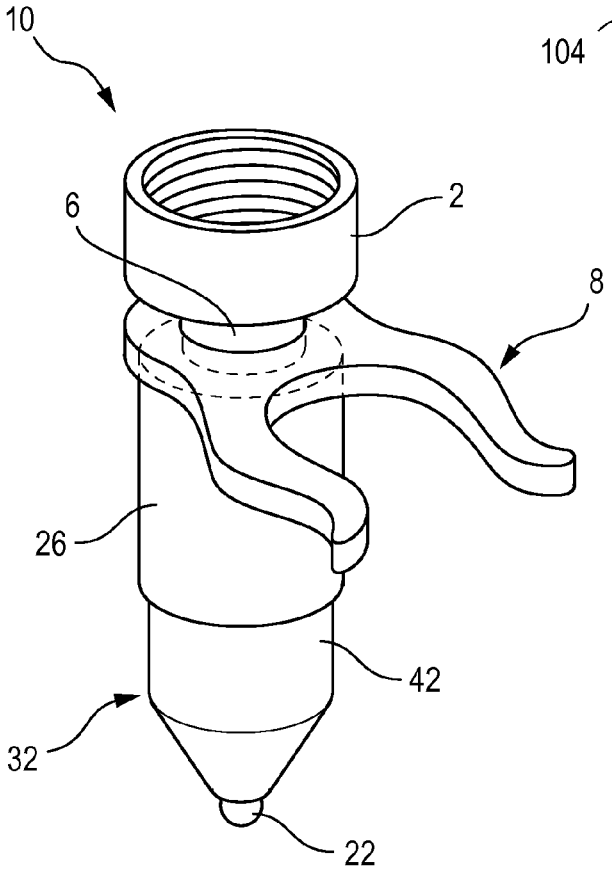
FIG. 12 is a perspective view of the water balloon filling device and water balloon tying fixture.

FIGS. 9-11 show a preferred way of tying a filled balloon 104 using the tying fixtures 8 herein. As shown in FIG. 9, the filled portion 100 of the balloon 102 is positioned away from the slot 16 and the open end 102 of the balloon 104 is pulled around the right and left prongs 14*a* and 14*b* such that the stretched portion of the balloon traverses across the slot 16 above and below the tying fixture 8, to form a loop. In this orientation, the filled portion 100 is positioned above the tying fixture 8 and the open end 102 is positioned below the tying fixture 8 on the same side as the filled portion 100. As shown in FIG. 10, the open end 102 is then stretched upward to be positioned above the slot 16. As shown in FIG. 11, the open end 102 is then threaded through the balloon loop created in the slot 16. When a user removes the balloon 104 from the tying fixture 8 in the position shown in FIG. 11, a knot will form where the open end 102 is threaded through the loop in the slot 6. During the tying process, the stretched part of the balloon preferably stays within the grooves 17*a* and 17*b* to prevent the balloon 102 from inadvertently slipping off. This method can readily be altered with respect to the specific orientations described above. More specifically the method can vary by interchanging top and bottom and left and right orientations of the balloon.

The invention may be embodied in other specific forms besides and beyond those described herein. The foregoing embodiments are therefore to be considered in all respects illustrative rather than limiting, and the scope of the invention is defined and limited only by the appended claims and their equivalents, rather than by the foregoing description.

What is claimed is:

1. A water balloon filling device comprising:

a) an attachment member having an upper opening configured to operably couple with a pressurized water source;

b) a main housing, having an upper portion coupled to the attachment member;

c) a spring vertically traversing within the main housing and having a bottom portion coupled to a lower nozzle, and configured to contract upwards and expand downwards;

d) an internal liner vertically traversing within the main housing, and having an upper opening in fluid communication with the attachment member and a lower opening in fluid communication with the lower nozzle, wherein the liner is configured such that no significant amount of water comes into contact with the spring;

e) the lower nozzle configured with the spring to allow vertical movement further into the main housing, and having a top opening in fluid communication with the liner and a bottom opening configured for filling a water balloon; and f) a stationary stem vertically traversing within the main housing, and comprising a bottom plug that is configured to fit snugly within the nozzle's bottom opening when the spring is expanded to prevent significant water flow out of the nozzle's bottom opening and wherein a gap is created between the bottom plug and the nozzle's bottom opening when the nozzle is pushed upwards, thereby contracting the spring.

2. The water balloon filling device of claim 1, wherein the internal liner is fabricated from a flexible, material.

3. The water balloon filling device of claim 2, wherein the internal liner is made of a waterproof material.

4. The water balloon filling device of claim 3, wherein the flexible waterproof material is selected from the group consisting of: ethylene propylene diene monome (EPDM) flexible rubber and PVC flexible plastic.

5. The water balloon filling device of claim 4, wherein the spring is coiled around the outside of the internal liner within the main housing.

6. The water balloon filling device of claim 1, further comprising a tying fixture operably coupled to the main housing and having two prongs with diverging ends that define a slot for tying a water balloon.

7. The water balloon filling device of claim 6, wherein the prongs are configured to converge towards each then have diverging ends.

8. The water balloon filling device of claim 6, wherein a connecting channel couples the attachment member to the main housing, and wherein the tying fixture includes an aperture configured to snugly fit around said connecting channel.

9. The water balloon filling device of claim 8, wherein the tying fixture is configured to be releasably attachable to the connecting channel.

10. The water balloon filling device of claim 8, wherein the connecting channel includes a bottom grate having a plurality of holes that allow water flow into the upper opening of the internal liner.

11. The water balloon filling device of claim 10, wherein the stem vertically traverses within the internal liner.

12. The water balloon filling device of claim 11, wherein the stem includes a top portion operably coupled to the underside of the bottom grate without blocking the plurality of holes on the grate.

13. The water balloon filling device of claim 12, wherein the top of the stem comprises four extensions in a cross shape that define four quadrants of the grate, wherein each quadrant includes a hole.

14. The water balloon filling device of claim 12, further comprising an inner compartment positioned directly below the grate within the main housing, wherein the inner compartment is coupled to the upward opening of the internal liner and a top portion of the spring.

15. The water balloon filler of claim 14, wherein the top of the stem is housed within the inner compartment.

16. The water balloon filler of claim 1, wherein the lower nozzle comprises two internal upward extensions that couple the bottom portion of the spring and the lower opening of the internal liner.

* * * * *